US006347707B1

(12) United States Patent
Süssegger et al.

(10) Patent No.: US 6,347,707 B1
(45) Date of Patent: Feb. 19, 2002

(54) SIFTING DEVICE FOR SIFTING GRANULAR MATERIAL

(75) Inventors: Albert Süssegger, Eitorf; Siegfried Strasser, Much, both of (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 09/662,296

(22) Filed: Sep. 15, 2000

(30) Foreign Application Priority Data

Sep. 16, 1999 (DE) ..... 199 44 421

(51) Int. Cl.[7] ..... B07B 7/04
(52) U.S. Cl. ..... 209/143; 209/133
(58) Field of Search ..... 209/133, 142, 209/143, 932, 134, 135, 138, 139.1

(56) References Cited

U.S. PATENT DOCUMENTS 3,972,808 A * 8/1976 Manley ..... 109/133
4,853,112 A * 8/1989 Brown ..... 209/142
5,021,149 A * 6/1991 Geisseler ..... 209/141
5,032,222 A * 7/1991 Millioud ..... 159/4.1
5,392,998 A 2/1995 Suessegger et al. ..... 241/79.1
6,152,310 A * 11/2000 Sakai et al. ..... 209/712

FOREIGN PATENT DOCUMENTS

DE A-42 23 762 1/1994 ..... B07B/4/02

* cited by examiner

*Primary Examiner*—Christopher P. Ellis
*Assistant Examiner*—Mark J. Beauchaine
(74) *Attorney, Agent, or Firm*—Sonnenschein Nath & Rosenthal

(57) ABSTRACT

In order to create a sifting device with integrated static sifter member and dynamic sifter member having at least one rotatably disposed rod basket such that the two sifter members are optimally coordinated so as to operate efficiently, particularly with moist sifting material to be dried, it is proposed in accordance with the invention to have a bypass line leave from the intermediate area between the static member and the dynamic member of the sifting device for drawing off a partial flow of the sifting air flow/sifting gas flow and to supply only the remaining outgoing sifting air of the static sifter member (static cascade sifter or V-sifter) to the dynamic sifter member with the at least one rotatably disposed rod basket.

20 Claims, 2 Drawing Sheets

29
24
18
28
25
27
16
26
17
23
12
19
21
20
22
11
10
15a
15b
13
14

SIFTING DEVICE FOR SIFTING GRANULAR MATERIAL

BACKGROUND OF THE INVENTION

The invention relates to a sifting device for sifting granular material having a static cascade sifter as a pre-sifting chamber followed by at least one rod basket of a dynamic sifter member rotatably disposed in the sifter housing, provided with turbo elements on the rotor circumference, having inlets for sifting air/sifting gas and sifting material and outlets for sifting air/sifting gas, fine, medium and coarse material.

DE-A-42 23 762, which corresponds with U.S. Pat. No. 5,392,998 specifies a sifting device having a static sifter member with no moving parts disposed inside a common sifter housing and a dynamic sifter member with rotating rod basket. In this case, the static sifter member is formed as a pre-sifting chamber for separating the coarse grain fraction contained in the granular material to be sifted, having two sifting zone limiting walls enclosed by the shaft-shaped sifter housing and forming a sifting zone between them and flowed through by the sifting air in cross flow, where said walls have baffle plates sloping diagonally downward in the direction toward the discharge opening for the separated coarse grain fraction disposed cascade-like or louver-like, where both baffle plate walls, and thus the sifting zone in between, are disposed sloping at an angle deviating from vertical. Because the sifting air in the static sifting member is deviated in a V-shape this is also referred to as a so-called V-sifter. Such a static V-sifter, included in a circulation grinding system, for example, with a material comminution roller press or roller mill, was found to be effective for energy-saving sifting and deagglomerating the grinding material in one single work process.

If the grinding material is moist, which is the case most of the time with cement raw meal, for example, the grinding material can also be dried in the static V-sifter member, in addition to being sifted and deagglomerated, if hot gas is used as sifting air, such as the hot waste gas from a cement clinker production line. In this case in particular, in view of the drying, relatively large hot gas or sifting gas quantities have to be used which then require a respectively sized rod basket or several such rod baskets for the rod basket sifter in the dynamic sifter member connected directly to the static V-sifter member, which could impair the efficient operation of the dynamic sifter member that separates the sifting material, from which the coarse grain fraction has been removed, into a medium grain fraction and fine material.

SUMMARY OF THE INVENTION

Therefore, the aim of the invention is to create a sifting device of the above described type having a static sifter member directly followed by a dynamic sifter member with at least one rotatably disposed rod basket such that the two sifter members are optimally coordinated so as to operate efficiently, particularly with moist sifting material, namely the static V-sifter member as a pre-sifter and drier, if applicable, and the dynamic sifter member as an instrument for final sifting and final drying, if applicable.

The problem is solved in accordance with the invention by means of a sifting device.

The sifting device of the invention is characterized in that from the intermediate area between the static member and the dynamic member of the sifting device a bypass line leaves via which a partial flow of the sifting air flow or sifting gas flow exiting the static sifter member is drawn off, for example in a quantity of approx. 20 to 80% so that only a small amount of sifting air/sifting gas reaches the downstream dynamic sifter member with the rod basket, which, as a result, can be dimensioned smaller.

The solid material contained in the bypass flow, which will be a mixture of medium and fine material, is separated from the bypass flow in an external solid matter separator and can represent an additional product of the sifting device. It is of particular advantage, however, to resupply said product, which was separated from the bypass flow in the solid matter separator, via a solid matter discharge line to the dynamic sifter member so as to subject said resupplied product to a final sifting and a final drying, if applicable, in the dynamic sifter member.

According to a further characteristic feature of the invention, the bypass line can leave from the top side of the sifter housing, and the solid matter separator for the bypass line can then be disposed above the sifting device, while the solid matter discharge line of the solid matter separator is advantageously inserted into the dynamic sifter member from the top. However, another option is to insert the solid matter discharge of the external solid matter separator partially or completely into the static sifter member. Another option is to have the bypass line leave from a side wall of the sifter housing instead of from the top side and to dispose the solid matter separator for the bypass line below the dynamic sifter member, if appropriate.

BRIEF DESCRIPTION OF THE DRAWINGS

The invention and further characteristic features and advantages thereof will be explained in more detail by means of the schematic exemplary embodiments shown in the figures, as follows.

DETAILED DESCRIPTION OF THE PREFERRED EMBODIMENTS

Figure 1:
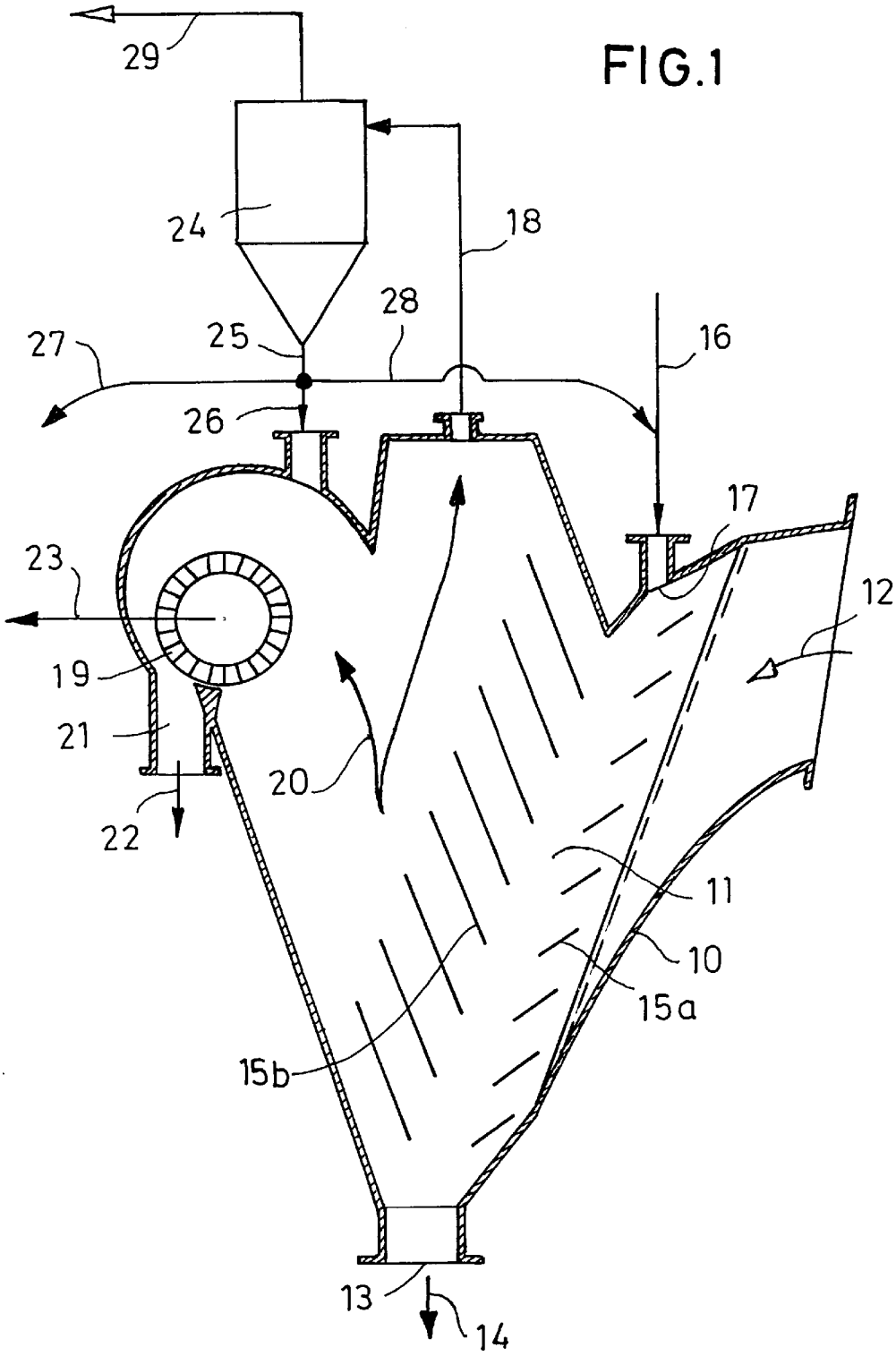
FIG. 1 is the first embodiment of the sifting device of the invention shown primarily in a side sectional view.

The sifting device in FIG. 1, substantially shown in vertical profile, has a V-shaped shaft-shaped housing 10 with two sifter zone limiting walls enclosed by the sifter housing and forming a sifter zone 11 between them. A sifting air 12 or hot gas as drying gas, and sometimes referred to simply as sifting gas, is flowed through the housing approximately in cross flow. The walls have baffle plates 15*a* and 15*b* sloping diagonally downward in the direction toward the discharge opening 13 for the separated coarse grain fraction 14. The baffle plates are disposed cascade-like or louver-like, where both baffle plate walls, and thus the sifting zone 11 lying between them, are disposed sloping at an angle deviating from the vertical.

The material 16 to be sifted is supplied through the material admission opening 17 at the top side of the static cascade sifter. When the material falls or slides over the baffle plate wall 15*a* of the cascade sifter, the sifting material is sifted in cross flow and any material agglomerates are deagglomerated at the same time. In case of a moist sifting material 16, such as moist cement raw meal, it is efficiently dried at the same time if the sifting medium used is a hot gas. Instead of the baffle plate walls 15*a* and 15*b*, perforated plates, such as sifter plates, etc., can also be used.

A bypass line 18 leaves from the top side of the housing 10 in an intermediate area between the static member and the dynamic member of the sifting device of the invention. Via this bypass line 18 a partial flow of the sifting air or the sifting gas flow is drawn off after the coarse grain fraction has already been removed.

Therefore, the rod basket 19 of the dynamic sifter member, having a horizontal rotational axis in the exemplary embodiment in FIG. 1, can be dimensioned smaller because only the remaining V-sifter outgoing air will reach the rod basket 19 of the dynamic sifter, as indicated by the arrow 20. While the medium grain fraction 22 is discharged at an outlet via a material lock 21 on the periphery of the rotating rod basket 19, the sifting air/sifting gas fine material flow indicated by the arrow 23 is drawn off via an outlet located at an least one of the two front sides of the rotating rod basket 19 and supplied to a dedusting device, which is not shown, for the purpose of separating the finished fine material. Such a dedusting device is shown in U.S. Pat. No. 5,392,998, incorporated herein by reference.

The bypass line 18, via which a partial flow of the sifting air 12 of the sifting gas charged with solid matter is drawn off, where said solid matter is a mixture of a fine grain fraction and a medium grain fraction, leads to a further processing device such as a separator 24 for separating the solid matter 25 contained in the bypass gas flow, which solid matter 25 is supplied from the top into the dynamic sifter member via line 26 for the purpose of final sifting and final drying, if applicable. However, there is an option of drawing off the solid matter 25 via line 27 as an independent product, but the solid matter 25 can also be supplied, partially or completely, via line 28 through the material admission opening 17 of the static sifter member. The solid matter separator 24 can be a separator cyclone, a dust filter, a sifter or another classification device. In any case, the sifting air/sifting gas flow 29 from which the solid matter has largely been removed is drawn off from the solid matter separator 24.

The amount of sifting gas flow which is drawn off through the bypass line 18 may be in the range of 20% to 80% of the total sifting gas flow entering the housing. An adjustable mechanism may be provided to vary the percentage of gas drawn off or the percentage may be fixed by the physical construction of the apparatus.

Figure 2:
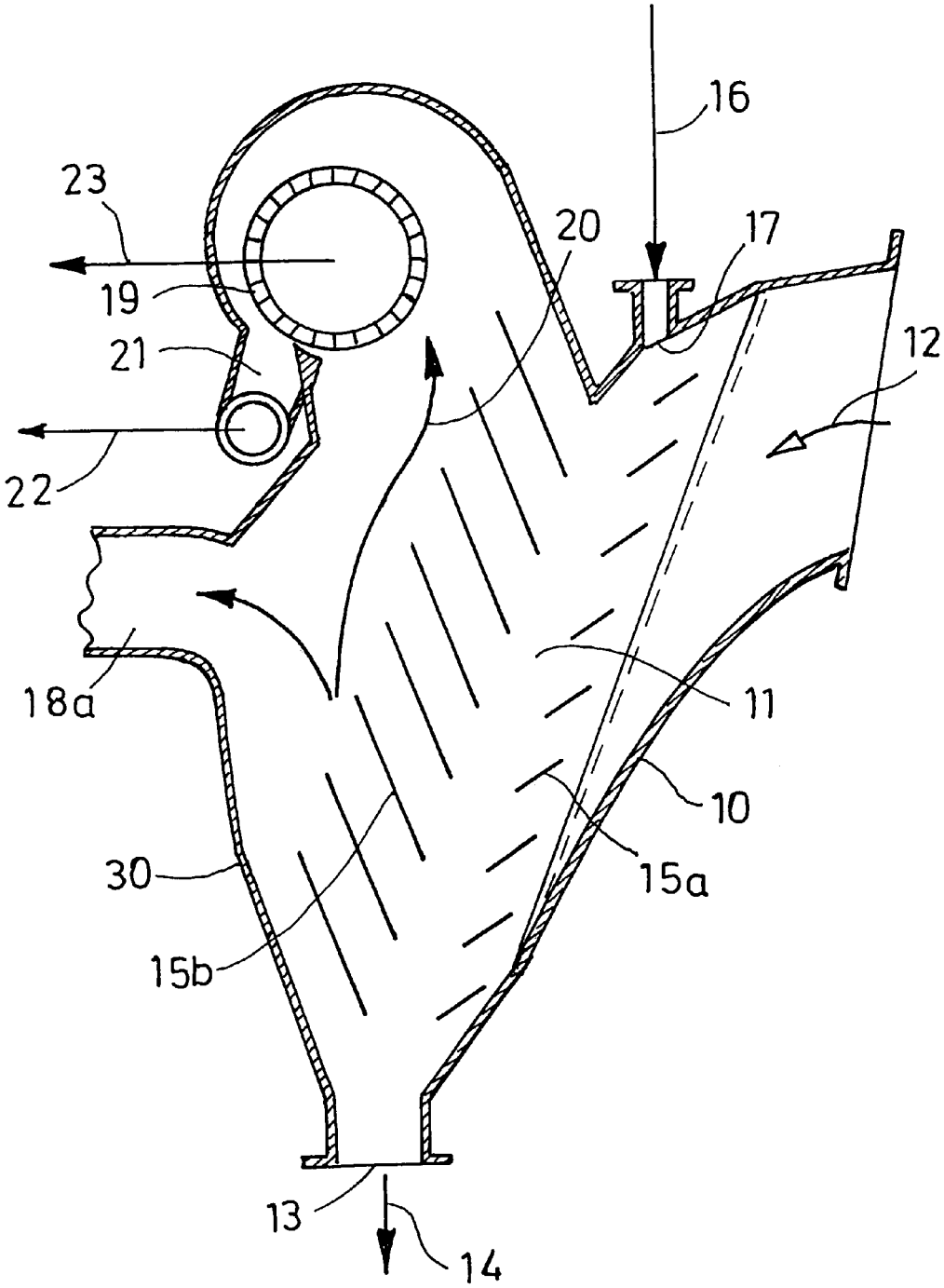
FIG. 2 is a second embodiment as a variant of FIG. 1 shown in a partial side sectional view.

In the exemplary embodiment in FIG. 2, the bypass line 18a does not leave from the top side of the sifter housing 10 as in FIG. 1, but from the left housing wall 30 instead, approximately below the rod basket 19. In this version too, there is also an option of resupplying the solid matter drawn off via the bypass line 18a into the dynamic and/or the static sifter member as shown and described in FIG. 1. The material lock 21 for discharging the medium grain fraction 22 from the dynamic sifter member can be a helix, an air supply channel, a vibro-channel or a pneumatic suction, etc.

As is apparent from the foregoing specification, the invention is susceptible of being embodied with various alterations and modifications which may differ particularly from those that have been described in the preceding specification and description. For example, the rotational axis of the dynamic sifter may be horizontal, vertical or diagonally sloping as is known in the art. It should be understood that we wish to embody within the scope of the patent warranted hereon all such modifications as reasonably and properly come within the scope of our contribution to the art.

We claim as our invention:

1. A sifting device for sifting granular material comprising a sifter housing having a static cascade sifter as a pre-sifting chamber followed by at least one rod basket of a dynamic sifter member rotatably disposed in the sifter housing, said housing having an inlet for a sifting gas, an inlet for sifting material, an outlet for the sifting gas, an outlet for fine material, an outlet for medium material and an outlet for coarse material, a bypass line located at an intermediate area between the static cascade sifter and the dynamic sifter member arranged to draw off a partial flow of the sifting gas flow.

2. A sifting device according to claim 1, including a further processing device flow connected to said bypass line for further processing the solid matter contained in said bypass gas flow.

3. A sifting device according to claim 1, wherein a rotational axis of the at least one rod basket rotatably disposed in the dynamic sifter member is disposed horizontally.

4. A sifting device according to claim 1, wherein a rotational axis of the at least one rod basket rotatably disposed in the dynamic sifter member is disposed vertically.

5. A sifting device according to claim 1, wherein a rotational axis of the at least one rod basket rotatably disposed in the dynamic sifter member is disposed diagonally sloping.

6. A sifting device according to claim 1, including a solid matter separator flow connected to said bypass line for separating out at least a portion of the solid matter contained in the bypass gas flow.

7. A sifting device according to claim 6, wherein the sifting device with the solid matter separator for the bypass line is combined into a compact unit.

8. A sifting device according to claim 6, wherein a solid matter discharge of the solid matter separator leads via a solid matter discharge line into the housing for resupplying at least the separated out solid matter, into the sifting device.

9. A sifting device according to claim 8, wherein the bypass line leaves from a top side of the sifter housing and the solid matter separator is disposed above the sifting device, and wherein the solid matter discharge line is inserted from the top into the housing.

10. A sifting device according to claim 8, wherein the bypass line leaves from a side wall of the sifter housing and the solid matter separator is disposed below the dynamic sifter member.

11. A sifting device for sifting granular material comprising:

a sifter housing having a static sifter region and a dynamic sifter region;

said housing having an inlet for a sifting gas, an inlet for sifting material, a first outlet for said sifting gas and for fine material, an outlet for medium material and an outlet for coarse material;

a second outlet for said sifter gas located in said housing at an intermediate area between said inlet for said sifter gas and said first outlet for said sifting gas and for fine material.

12. A sifting device according to claim 11, wherein said static sifter region includes a series of baffle plates arranged below said inlet for sifting material to receive said sifting material falling thereon under the influence of gravity and said inlet for said sifting gas arranged to direct flow of said sifting gas through said baffle plates in a cross flow.

13. A sifting device according to claim 11, wherein said dynamic sifter region includes a rod basket incorporating, as a part thereof, said first outlet for said sifting gas and fine material.

14. A sifting device according to claim 11, wherein said second outlet is located in a top side of said housing.

15. A sifting device according to claim 11, wherein said second outlet is located in a side wall of said housing.

16. A sifting device according to claim 11, wherein said second outlet is connected to a line leading to a solid matter separator wherein solid matter is separated from sifter gas exiting at said second outlet.

17. A sifting device according to claim 16, wherein said solid matter separator includes a solid matter discharge line leading therefrom which is connected to said housing to reintroduce separated solid matter into said sifting device.

18. A sifting device for sifting granular material comprising:

a sifter housing having a static sifter region and a dynamic sifter region;

said housing having an inlet for a sifting gas in said static sifter region, an inlet for sifting material at said static sifter region, a first outlet for said sifting gas and for fine material at said dynamic sifter region, an outlet for medium material at said dynamic sifter region and an outlet for coarse material at said static sifter region;

a second outlet for said sifter gas located in said housing at an intermediate area between said inlet for said sifter gas and said first outlet for said sifting gas and for fine material.

19. A sifting device according to claim 18, wherein said static sifter region includes a series of baffle plates arranged below said inlet for sifting material to receive said sifting material falling thereon under the influence of gravity, said inlet for said sifting gas arranged to direct sifting gas flow through said baffle plates in a cross flow and said outlet for coarse material arranged below said baffle plates to receive coarse material falling from said baffle plates under the influence of gravity.

20. A sifting device according to claim 18, wherein said dynamic sifter region includes a rod basket incorporating, as a part thereof, said first outlet for said sifting gas and fine material, and said outlet for medium material is positioned below said rotatable rod basket to receive said medium material.

* * * * *